US005429541A

United States Patent [19]

Landon

[11] Patent Number: 5,429,541

[45] Date of Patent: Jul. 4, 1995

[54] PORTABLE SAND BLANKET WITH ASSOCIATED TOYS

[76] Inventor: Sally J. Landon, 7798 N. Portage St., Westfield, N.Y. 14787

[21] Appl. No.: 223,037

[22] Filed: Apr. 5, 1994

[51] Int. Cl.[6] ..... A63H 33/32; B65D 33/28

[52] U.S. Cl. ..... 446/70; 446/75; 5/417; 383/4

[58] Field of Search ..... 446/70, 71, 75, 77, 446/227; 383/4, 76; 190/2; 5/417

[56] References Cited

U.S. PATENT DOCUMENTS

| | | | |
|---|---|---|---|
| 2,078,022 | 4/1937 | Roemer | 446/227 |
| 3,434,232 | 3/1969 | Tarrson | 446/70 |
| 4,337,812 | 7/1982 | Trinkner | 383/4 |
| 5,195,828 | 3/1993 | Bush-Rodriguez | 5/417 X |

*Primary Examiner*—Mickey Yu

[57] ABSTRACT

A portable sand blanket with associated toys including: a blanket formed in a flat circular configuration of a durable plastic material, the blanket having six holes therethrough located at essentially equally spaced locations adjacent to the periphery, grommets positioned through the holes of the blanket and a single rope in a circular configuration threaded sequentially through the holes and grommets, the rope extending on the upper and lower surfaces of the blanket alternatively. A container for said having upstanding side wall in a circular configuration, the container having a circular base, the side wall coupled at their lower edges to the base to define a container for sand, the lower surface of the container including its base being permanently secured to the blanket at a central extent thereof, the sand container having a lid formed with a circular upper extent and downwardly extending side wall in a circular configuration to fit over the upper edge of the side wall of the container. A tool adapted for use by a child when playing with sand, the tool having a handle end with a loop and also a functional end, the tool having in association with that a releasable clip permanently secured to the upper surface of the blanket and having a reception area adapted to releasably receive the loop of the tool.

5 Claims, 4 Drawing Sheets

PORTABLE SAND BLANKET WITH ASSOCIATED TOYS

BACKGROUND OF THE INVENTION

1. Field of the Invention

The present invention relates to a portable sand blanket with associated toys and more particularly pertains to entertaining and educating children in building with sand on a portable blanket.

2. Description of the Prior Art

The use of beach blankets and sand toys is known in the prior art. More specifically, beach blankets and sand toys heretofore devised and utilized for the purpose of building sand castles on the beach or in sand boxes are known to consist basically of familiar, expected and obvious structural configurations, notwithstanding the myriad of designs encompassed by the crowded prior art which have been developed for the fulfillment of countless objectives and requirements.

By way of example, U.S. Pat. Nos. Des. 273,508 and Des. 308,088 to Mariol disclose a sandbox and toy sandbox.

U.S. Pat. No. Des. 313,058 to Wehmeyer discloses a sandbox.

U.S. Pat. No. Des. 321,382 to Laib et al. discloses a sand pail toy or the like.

Lastly, U.S. Pat. No. 3,454,272 to Elkington et al. discloses a child's playpen and sandbox device.

In this respect, the portable sand blanket with associated toys according to the present invention substantially departs from the conventional concepts and designs of the prior art, and in doing so provides an apparatus primarily developed for the purpose of entertaining and educating children in building with sand on a portable blanket.

Therefore, it can be appreciated that there exists a continuing need for new and improved portable sand blanket with associated toys which can be used for entertaining and educating children in building with sand on a portable blanket. In this regard, the present invention substantially fulfills this need.

SUMMARY OF THE INVENTION

In view of the foregoing disadvantages inherent in the known types of beach blankets and sand toys now present in the prior art, the present invention provides an improved portable sand blanket with associated toys. As such, the general purpose of the present invention, which will be described subsequently in greater detail, is to provide a new and improved portable sand blanket with associated toys and method which has all the advantages of the prior art and none of the disadvantages.

To attain this, the present invention essentially comprises a new and improved portable sand blanket with associated toys comprising, in combination, a blanket formed in a flat circular configuration of a durable plastic material, the blanket having six holes therethrough located at essentially equally spaced locations adjacent to the periphery, grommets positioned through the holes of the blanket and a single rope in a circular configuration threaded sequentially through the holes and grommets, the rope being of a sufficient length so that the blanket may be laid flat on a recipient surface without the ropes puckering the blanket, the ropes extending on the upper and lower surfaces of the blanket alternately whereby a user may grasp the rope on the upper surface to lift the blanket and its contents into a pouch for transportation purposes; a container for sand, the container having upstanding side walls in a circular configuration, the container having a circular base, the side walls coupled at their lower edges to the base to define a container for sand, the lower surface of the container including its base being permanently secured to the blanket at a central extent thereof, the sand container having a lid formed with a circular upper extent and downwardly extending side walls in a circular configuration to fit over the upper edge of the side walls of the container to ensure the retention of sand within the container when the lid is on the container; a shovel adapted for use by a child when playing with sand in the container or moved from the container to the surface of the blanket, the shovel having a handle end and a functional end with the handle end including a loop, the shovel having in association with that a releasable clip permanently secured to the upper surface of the blanket and having a reception area adapted to releasably receive the loop of the shovel; a mold adapted for use by a child when playing with sand in the container or moved from the container to the surface of the blanket, the mold having a handle end and a functional end with the handle end including a loop, the mold having in association with that a releasable clip permanently secured to the upper surface of the blanket and having a reception area adapted to releasably receive the loop of the mold; and a bucket adapted for use by a child when playing with sand in the container or moved from the container to the surface of the blanket, the bucket having a handle end and a functional end with the handle end including a loop, the bucket having in association with that a releasable clip permanently secured to the upper surface of the blanket and having a reception area adapted to releasably receive the loop of the bucket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved portable sand blanket with associated toys which has all the advantages of the prior art beach blankets and sand toys and none of the disadvantages.

It is another object of the present invention to provide new and improved portable sand blanket with associated toys which may be easily and efficiently manufactured and marketed.

It is a further object of the present invention to provide new and improved portable sand blanket with associated toys which are of a durable and reliable construction.

An even further object of the present invention is to provide new and improved portable sand blanket with associated toys which is susceptible of a low cost of manufacture with regard to both materials and labor, and which accordingly is then susceptible of low prices of sale to the consuming public, thereby making such portable sand blanket with associated toys economically available to the buying public.

Still yet another object of the present invention is to provide new and improved portable sand blanket with associated toys which provides in the apparatuses and methods of the prior art some of the advantages thereof, while simultaneously overcoming some of the disadvantages normally associated therewith.

Still another object of the present invention is to entertain and educate children in building with sand on a portable blanket.

Lastly, it is an object of the present invention is to provide new and improved portable sand blanket with associated toys comprising a blanket formed in a flat circular configuration of a durable plastic material, the blanket having six holes therethrough located at essentially equally spaced locations adjacent to the periphery, grommets positioned through the holes of the blanket and a single rope in a circular configuration threaded sequentially through the holes and grommets, the rope being of a sufficient length so that the blanket may be laid flat on a recipient surface without the ropes puckering the blanket, the ropes extending on the upper and lower surfaces of the blanket alternately whereby a user may grasp the rope on the upper surface to lift the blanket and its contents into a pouch for transportation purposes; and a container for sand, the container having upstanding side walls in a circular configuration, the container having a circular base, the side walls coupled at their lower edges to the base to define a container for sand, the lower surface of the container including its base being permanently secured to the blanket at a central extent thereof, the sand container having a lid formed with a circular upper extent and downwardly extending side walls in a circular configuration to fit over the upper edge of the side walls of the container to ensure the retention of sand within the container when the lid is on the container; and a tool adapted for sue by a child when playing with sand in the container or moved from the container to the surface of the blanket, the tool having a handle end and a functional end with the handle end including a loop, the tool having in association with the blanket and having a reception area adapted to releasably receive the loop of the tool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
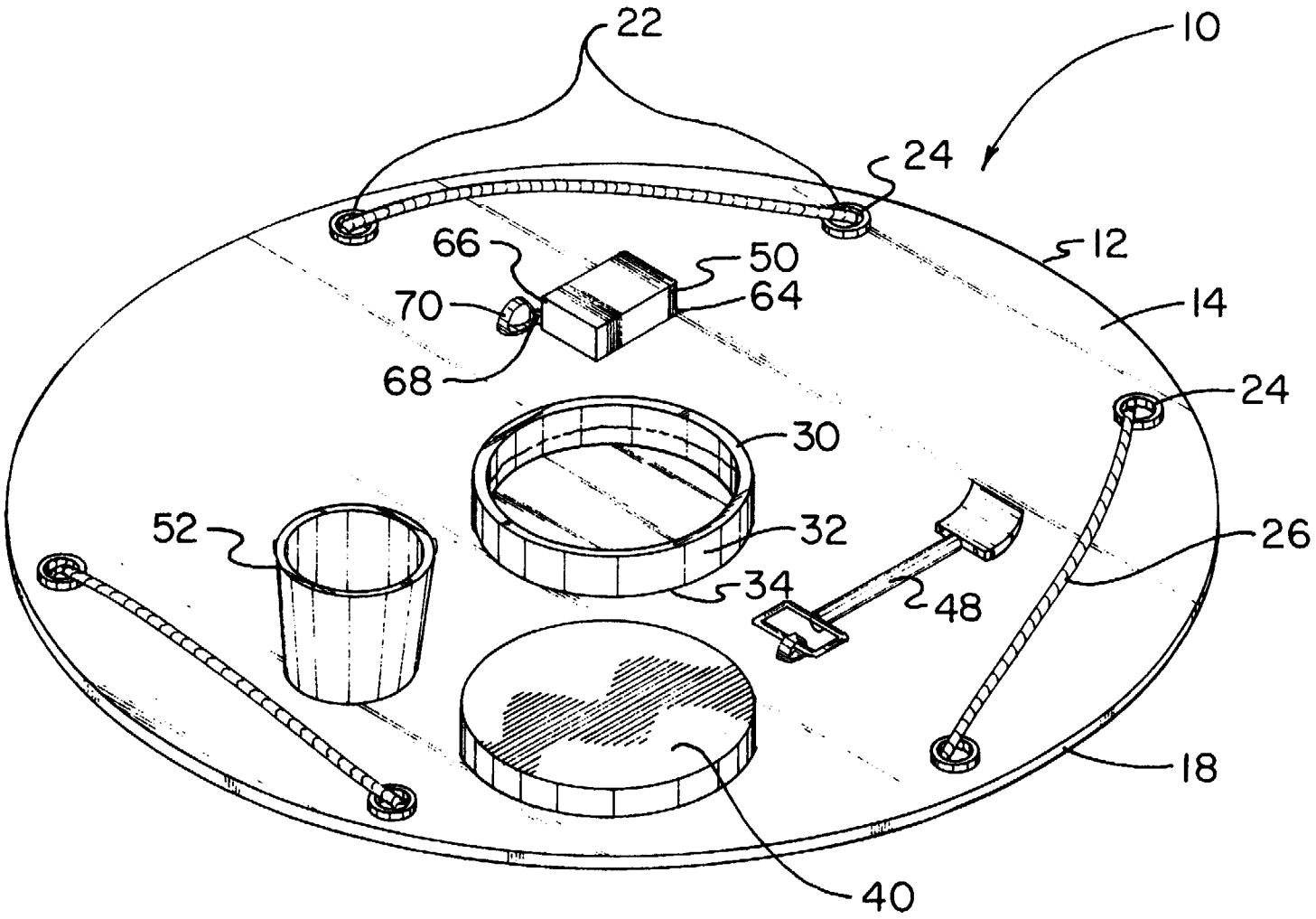
FIG. 1 is a perspective illustration of the preferred embodiment of the portable sand blanket with associated toys constructed in accordance with the principles of the present invention.
Figure 2:
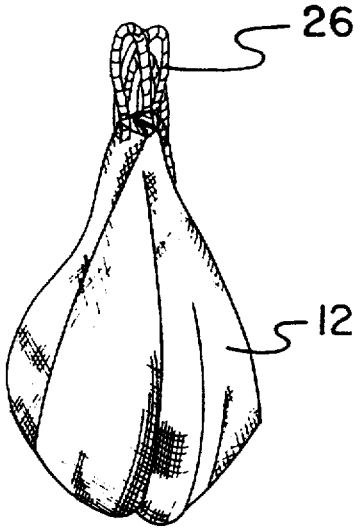
FIG. 2 is a perspective view of the device illustrated in FIG. 1 but shown in the gathered-up orientation.
Figure 3:
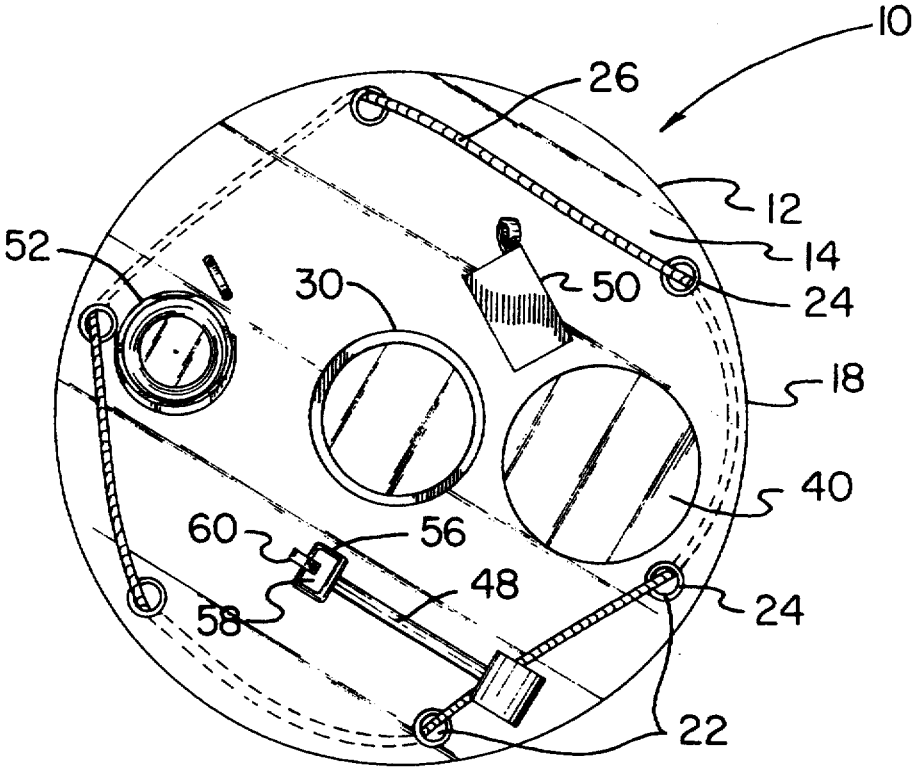
FIG. 3 is a top plan view of the device illustrated in FIGS. 1 and 2.
Figure 4:
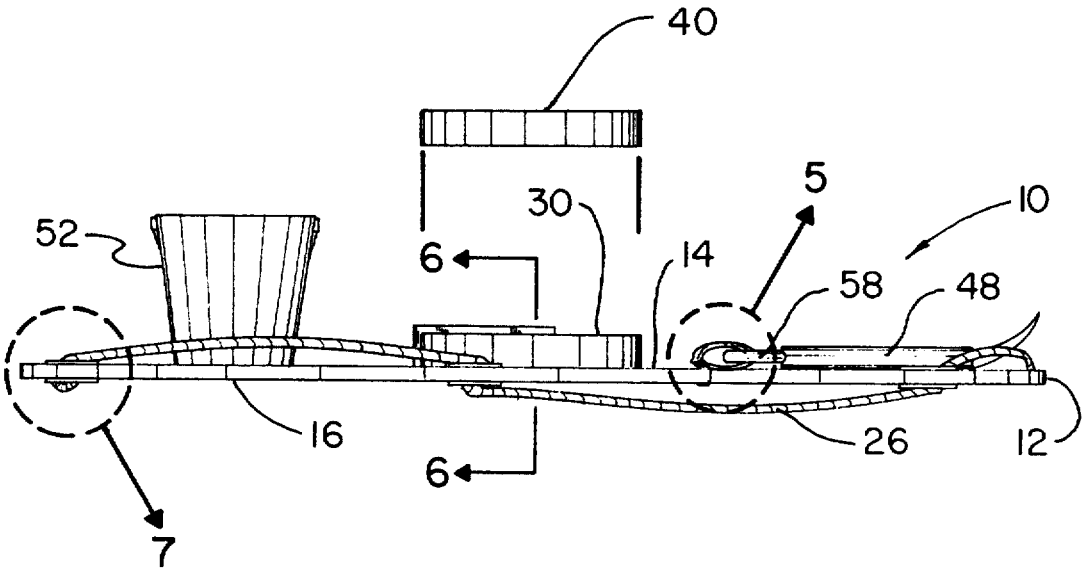
FIG. 4 is a side elevational view of the device shown in the prior Figures.
Figure 5:
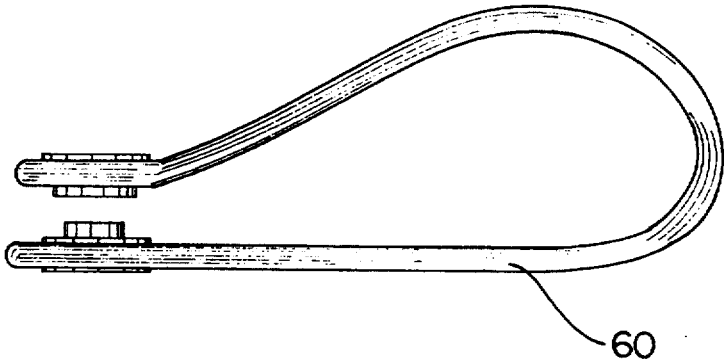
FIG. 5 is a side elevational view of the one of the clips taken along circle 5 of FIG. 4.
Figure 6:
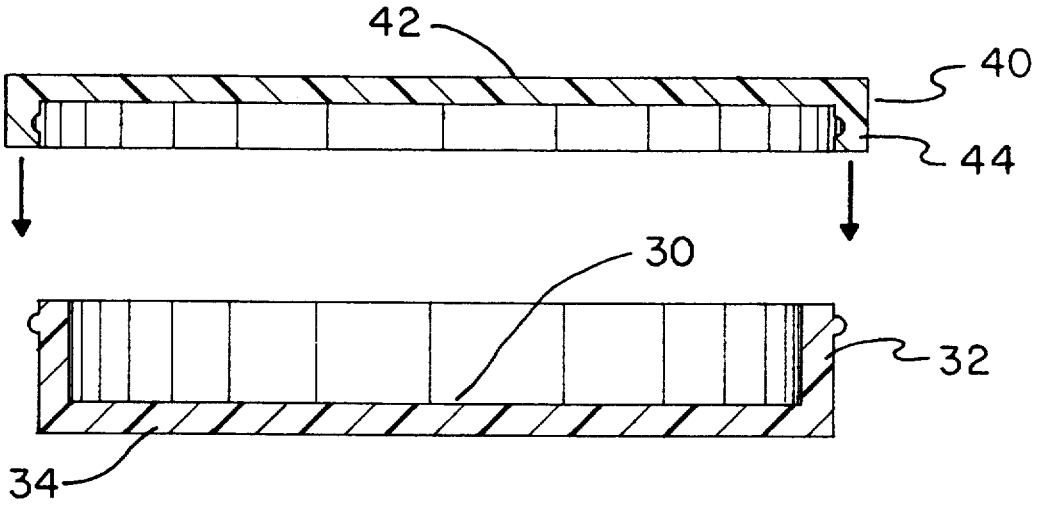
FIG. 6 is a cross sectional view taken along line 6—6 of FIG. 4.
Figure 7:
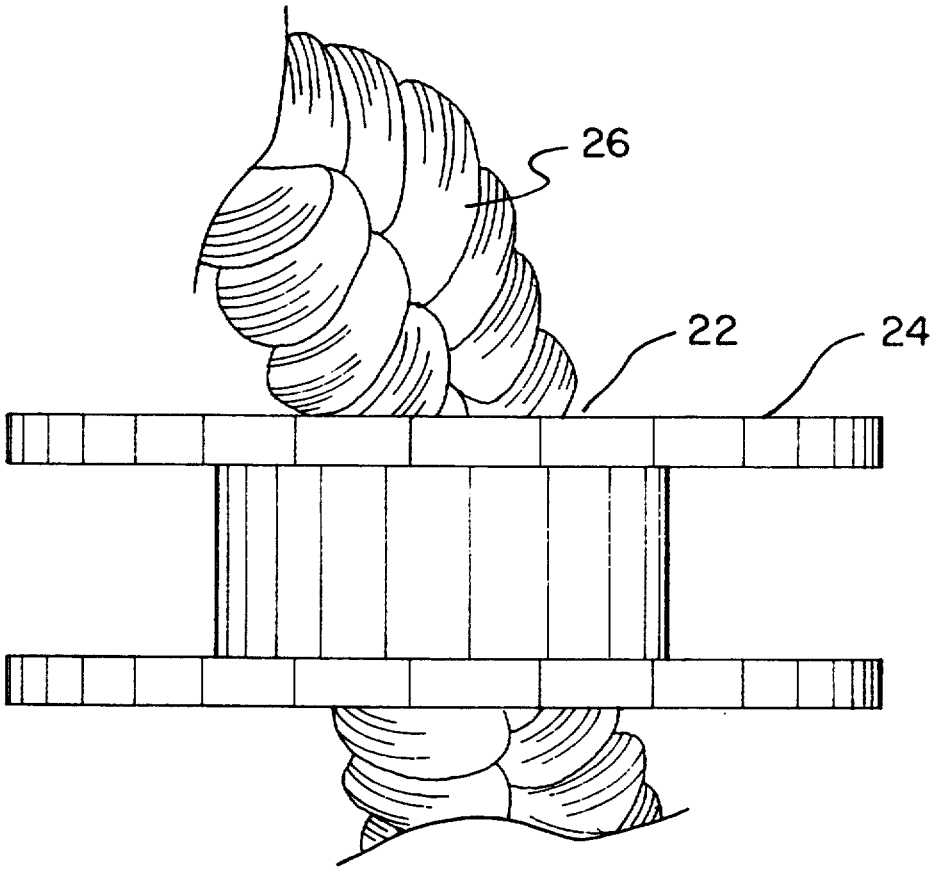
FIG. 7 is an enlarged side elevational view of one of the grommets and a portion of the rope taken along line 7—7 of FIG. 4.

With reference now to the drawings, and in particular to FIG. 1 thereof, the preferred embodiment of the new and improved portable sand blanket with associated toys embodying the principles and concepts of the present invention and generally designated by the reference numeral 10 will be described.

Specifically, the present invention is in a system 10 comprised of a plurality of components. In their broadest context, such components include a blanket with an associated tie rope, a container for sand secured to the middle of the blanket, and one or more tools releasably coupled to the blanket. Such components are individually configured and correlated one with respect to the other to attain the desired objectives.

More specifically, the blanket 12 is constructed of a circular configuration. It is of sufficient size to allow a child to stand or crawl thereover while playing games thereon. The preferred games are games involved with building and manipulating the sand. In the preferred embodiment the blanket is at least 4 feet in diameter. It could be slightly smaller or much larger as a function of the age or size of the child or children to play thereon. The blanket has an upper surface 14 upon which the child will play. The blanket also has a lower surface 16 adapted to be placed over the recipient surface to support the blanket and the child thereon. Such recipient surface is normally the ground but it could be the floor of the playroom. The blanket also has an external periphery 18.

Located spaced inwardly a slight distance from the periphery of the blanket are a plurality of holes 22. In the preferred embodiment, an even number of holes, preferably six are so formed. The holes are of essentially equal size and equally spaced around the periphery. Located within each hole is a grommet 24. The grommet is a rigid member through which a rope 26 may be passed. The grommets preclude excess wear on the blanket itself. The blanket is preferably made of a weather resistant and water resistant material of any of a variety of flexible toxicly safe plastics. The preferred material is vinyl. The grommets are similarly made of a toxic resistant material. They are, however, rigid in nature. A plastic or rubber grommet is preferred. Metal grommets may also be utilized. A preferred material for the grommet is polypropylene.

In association with the blanket, holes, and grommets is a flexible rope 26. The rope is a continuous member in a closed loop configuration. It is of sufficient length that when passed through the holes and grommets in alternating fashion, it will allow the blanket to be laid flat on the recipient surface without the rope being too short for causing the periphery of the blanket to pucker. The rope should not be excessively longer than is needed. The function of the rope is to allow a user to grasp the alternate sections of the rope on the upper surface and to pull them upwardly. In this manner, the blanket will form a pouch with the materials previously on the upper surface of the blanket to be retained therein for transportation purposes. A preferred material for the rope is, again a toxicly safe material. Nylon is preferred. Such nylon rope would be an inexpensible which would preclude unnecessary stretching or shrinkage and allow continued use of the rope and its function over an extended period of time.

The next major component of the system is the sand container 30. The sand container is a components having upstanding vertical side walls in a circular configuration. The side walls 32 are preferably cylindrical at an even diameter throughout its vertical extent. In the preferred embodiment, the container is about a foot in diameter and constitutes about 20 percent of the diameter of the blanket. It may be of a greater or lesser extent depending on the size of the blanket and the quantity of sand to be contained. A container of about a foot in diameter and about 6 inches in height will contain about 2 gallons of sand. Such a quantity has been found adequate for most children in the 2 to 5 year range when playing alone. A larger blanket with a larger container with more sand would be more susceptible for use by larger or older children or when plural children are to use a single blanket and containers. The container has rigid upstanding side walls 32 and a lower circular base 34. The periphery of the base is permanently connected to the lower edges of the side walls. The upper surface of the base is adapted to support the sand in the container. The lower surface of the base as well as the lower edges of the side walls are adapted to be permanently secured to the central extent of the upper surface of the blanket. In this manner, the container with the sand is always in proper position on the blanket for use by a child playing with the present invention.

In operational use with the container is a lid 40. The lid has a circular component 42 with downwardly extending side walls 44. The size of the lid is such that the lower edges of the side walls may be slid downwardly over the upper edges of the side walls of the container and press-fit thereon. As such, the sand within the container will be retained therein despite the fact that the blanket with its container might be moved from one location to another or inadvertently tipped. As such, sand will be only taken from the container when the lid is specifically removed and the child or a supervising parent takes the sand from the container. The preferred material for the container as well as the lid is preferably a rigid plastic which is ecologically safe. Polyvinyl chloride (PVC) is a preferred material with a wide range of other materials, plastic or metal, or other rigid construction could readily be utilized.

The last component of the system are a plurality of tools. In the preferred embodiment, a variety of types of tools could be utilized. Such tools include a shovel 48, a mold 50, and a bucket 52. In the preferred embodiment, one of each such tool is shown. It should be understood, however, that any number of tools and nay combination thereof could be utilized. For example, a single shovel could be utilized to the preclusion of a mold and bucket. Two or more shovels could be utilized to preclusion of the other tools. Further, any two or three other shown tools could be utilized.

Each of the tools has a handle end and a operational end. With regard to the shovel, the handle end 56 is of an elongated construction. The operational end is a generally planar member with a curved end for shoveling in a conventional fashion. The handel end includes a loop 58. The loop is adapted for being coupled to the upper surface of the blanket. Coupling is effected through a clip 60. The clip is of a generally rigid but slightly flexible material. One edge of the clip is permanently secured to the blanket at a location between the container and the periphery. In addition to having a permanently attached region, each clip has a flexible opening. The flexible opening is adapted to be opened to an extent sufficient to allow the looped portion of the tool to be slid therein for removably coupled with respect to the blanket. The opening may be separated so that the looped end of the tool may be moved when a child wishes to play with such tool.

The other tools include a mold 50 adapted to receive sand and placed upside down to create a structure. The mold has an operational end 64 and a handle end 66 with a loop 68 for being removably coupled to a clip 70.

Similarly, the bucket has an operational end 74 in the form of the bucket. It also has a handle 76 at its operational end 78. The handle provides a surface of being removably coupled with respect to its clip.

The present invention is designed to serve as an instant sandbox which is completely portable and may be used by children at any location around the home or when traveling. It is comprised of a circular section of vinyl material, a length of nylon rope, a sand container, a bucket, two shovels and a sand mold. The circular section serves as the blanket and has six equally spaced holes near its perimeter, and a continuous nylon rope is threaded through each while passing alternately over and under the blanket. Hence, three separate chordal extensions remain visible at the top of the blanket.

The sand container has a capacity of about two pounds and has a snap-on lid. This container is permanently affixed to the central area of the blanket while the remaining accessories are independent and may move around freely. Hence it can be seen that a child will be pleasantly occupied for hours as he/she would with any similar array of toys; however, the innovation in this idea is the convenience afforded the parent or guardian when it is time to move the play area or depart the site being visited.

One need only close the sand container, grasp each of the three exposed nylon rope sections and pull in an upward direction to form a convenient pouch containing both the sand and the other loose articles. The cinched sections of the rope serve as a convenient handle, and the pouch may be carried in one hand and compactly stored in the trunk or rear seat of a vehicle. The present invention will be a handy acquisition indeed for any parent or guardian.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved portable sand blanket with associated toys comprising, in combination:

a blanket formed in a flat circular configuration of a durable plastic material, the blanket having six holes therethrough located at essentially equally spaced locations adjacent to the periphery, grommets positioned through the holes of the blanket and a single rope in a circular configuration threaded sequentially through the holes and grommets, the rope being of a sufficient length so that the blanket may be laid flat on a recipient surface without the rope puckering the blanket, the rope extending on the upper and lower surfaces of the blanket alternately whereby a user may grasp the rope on the upper surface to lift the blanket and its contents into a pouch for transportation purposes;

a container for sand, the container having upstanding side wall in a circular configuration, the container having a circular base, the side wall coupled at its lower edge to the base to define a container for sand, the lower surface of the container including its base being permanently secured to the blanket at a central extent thereof, the sand container having a lid formed with a circular upper extent and downwardly extending side wall in a circular configuration to fit over the upper edge of the side wall of the container to ensure the retention of sand within the container when the lid is on the container;

a shovel adapted for use by a child when playing with sand in the container or moved from the container to the surface of the blanket, the shovel having a handle end and a functional end with the handle end including a loop, the shovel having in association with that a releasable clip permanently secured to the upper surface of the blanket and having a reception area adapted to releasably receive the loop of the shovel;

a mold adapted for use by a child when playing with sand in the container or moved from the container to the surface of the blanket, the mold having a handle end and a functional end with the handle end including a loop, the mold having in association with that a releasable clip permanently secured to the upper surface of the blanket and having a reception area adapted to releasably receive the loop of the mold; and a bucket adapted for use by a child when playing with sand in the container or moved from the container to the surface of the blanket, the bucket having a handle end and a functional end with the handle end including a loop, the bucket having in association with that a releasable clip permanently secured to the upper surface of the blanket and having a reception area adapted to releasably receive the loop of the bucket.

2. A portable sand blanket with associated toys comprising:

a blanket formed in a flat circular configuration of a durable plastic material, the blanket having six holes therethrough located at essentially equally spaced locations adjacent to the periphery, grommets positioned through the holes of the blanket and a single rope in a circular configuration threaded sequentially through the holes and grommets, the rope being of a sufficient length so that the blanket may be laid flat on a recipient surface without the rope puckering the blanket, the rope extending on the upper and lower surfaces of the blanket alternatively whereby a user may grasp the rope on the upper surface to lift the blanket and its contents into a pouch for transportation purposes; and a container for sand, the container having upstanding side wall in a circular configuration, the container having a circular base, the side wall coupled at its lower edge to the base to define a container for sand, the lower surface of the container including its base being permanently secured to the blanket at a central extent thereof, the sand container having a lid formed with a circular upper extent and downwardly extending side wall in a circular configuration to fit over the upper edge of the side wall of the container to ensure the retention of sand within the container when the lid is on the container; and a tool adapted for use by a child when playing with sand in the container or moved from the container to the surface of the blanket, the tool having a handle end and a functional end with the handle end including a loop, the tool having in association with that a releasable clip permanently secured to the upper surface of the blanket and having a reception area adapted to releasably receive the loop of the tool.

3. The apparatus as set forth in claim 2 wherein the tool is at least one shovel with an associated clip securing the shovel to the upper surface of the blanket.

4. The apparatus as set forth in claim 2 wherein the tool is at least one mold with an associated clip securing the mold to the Upper surface of the blanket.

5. The apparatus as set forth in claim 2 wherein the tool is at least one bucket with an associated clip securing the bucket to the upper surface of the blanket.

* * * * *